United States Patent [19]

Ertz

[11] Patent Number: 4,917,517

[45] Date of Patent: Apr. 17, 1990

[54] COMBINED HAND SUPPORT AND WRITING INSTRUMENT HOLDER

[75] Inventor: Paula Ertz, Newport Beach, Calif.

[73] Assignee: Smith & Nephew Rolyan, Inc., Menomonee Falls, Wis.

[21] Appl. No.: 230,896

[22] Filed: Aug. 11, 1988

[51] Int. Cl.[4] ..... B43K 23/00; B43K 29/00

[52] U.S. Cl. ..... 401/6; 401/48

[58] Field of Search ..... 401/48, 6; 15/437, 443

[56] References Cited

U.S. PATENT DOCUMENTS

| | | | |
|---|---|---|---|
| 2,497,418 | 2/1950 | Schroeder, Jr. | 401/48 |
| 3,972,628 | 8/1976 | Stevers | 401/48 |
| 4,037,975 | 7/1977 | Huffman | 401/6 |
| 4,111,566 | 9/1978 | Kenwell | 401/48 X |

*Primary Examiner*—Steven A. Bratlie

*Attorney, Agent, or Firm*—Morland C. Fischer

[57] ABSTRACT

A combined hand support and writing instrument holder that has particular application as a writing aid for those who suffer from a disability or are of an advanced age at which writing by hand is a different and hard to control task. The presently disclosed hand support and writing instrument holder releasably retains a writing instrument in contact with a writing paper and provides a comfortable contour for receiving and supporting the user's hand. Thus, the disclosed device may be easily and controllably moved over a writing surface with a steady and even writing motion so that words, and the like, may be more accurately and legibly written. The combined hand support and writing instrument holder is adapted to be rocked back and forth over a pivot point so that the writing instrument may be easily raised above (or lowered into contact with) the writing paper when it is desirable to relocate the instrument without making extraneous marks on the paper and without requiring the user to first remove his hand from the device.

4 Claims, 3 Drawing Sheets

COMBINED HAND SUPPORT AND WRITING INSTRUMENT HOLDER

BACKGROUND OF THE INVENTION

1. Field of the Invention

This invention relates to the combination hand support and writing instrument holder which functions as a writing aid for those experiencing difficulty in writing by hand, so that words may now be more accurately and legibly written with a controlled and steady writing motion.

2. Prior Art

Various physical infirmities, illnesses, disabilities and/or aging are known to affect the ability of certain individuals to write with a writing instrument. For example, arthritis coupled with advanced age may make it extremely difficult for an older individual to hold or move a writing instrument across a writing paper. In other cases, the writer's hand may shake or be characterized by uncontrollable movements, whereby written words are either illegible or hard to comprehend. In still other cases, the task of writing may be so difficult or arduous that an inordinate amount of time and effort is required to write even a few words.

In each of the aforementioned cases, the writer is faced with the frustration that commonly comes from knowing that one may be unable to accurately and efficiently write a simple letter. Moreover, the writer may become increasingly isolated from his family and friends, since communication by the written word may be virtually impossible.

Accordingly, it would be desirable to have available a writing aid which would enable the user to more efficiently and legibly write words with a steady and more evenly controlled writing motion. To this end, the following U.S. Patents provide examples of writing aids which are controlled by the user to better enable him to write words, and the like: No. 2,497,418 issued Feb. 14, 1950; No. 3,972,628 issued Aug. 3, 1976;

However, in none of the above-identified examples is the writing aid adapted to rotate around a pivot surface so that an associated writing instrument may be selectively raised above (or lowered towards) a writing paper when it is desirable to relocate a writing instrument without making extraneous marks on the paper and Without requiring the user to first remove his hand from the writing aid.

SUMMARY OF THE INVENTION

In general terms, a combination hand support and writing instrument holder is disclosed that functions as a writing aid for those who are unable to write because of a disability and/or advanced age. The disclosed device comprises a body portion which is sized and contoured to receive and support the hand of a user. A head portion projects outwardly from one end of the body portion. A hole is formed through the head portion through which a writing instrument is releasably and removably retained for making contact with a writing paper. A tail portion projects outwardly from the opposite end of the body portion to provide a means by which the movement of the device may be more easily controlled The bottom of the body portion is characterized by a pair of planar surfaces that are coextensively joined to one another at a pivot point. The first planar surface is aligned parallel with the writing surface upon which the writing paper is laid, and the second planar surface is aligned at an acute (e.g. approximately 15 degrees) angle with respect to the writing surface.

In operation, the user rests his hand upon the contoured body portion and slides the hand support and writing instrument holder along the first planar surface thereof to trace out various letters and words. Accordingly, the writing instrument which is being carried at the head portion of the device writes the corresponding letters and words on the writing paper. The user exerts a downward force on the tail portion when it is desirable to relocate the writing instrument without making extraneous marks on the paper and without requiring the user to first remove his hand from the body portion. Accordingly, the body portion rotates, in a first direction, around the pivot point, whereby the writing instrument is raised above the writing paper. The user then slides the hand support and writing instrument holder along the second planar surface thereof to the desired location relative to the writing surface. The body portion is rotated in an opposite direction around the pivot point, whereby the writing instrument is moved back into contact with the writing paper.

DESCRIPTION OF THE PREFERRED EMBODIMENT

Figure 1:
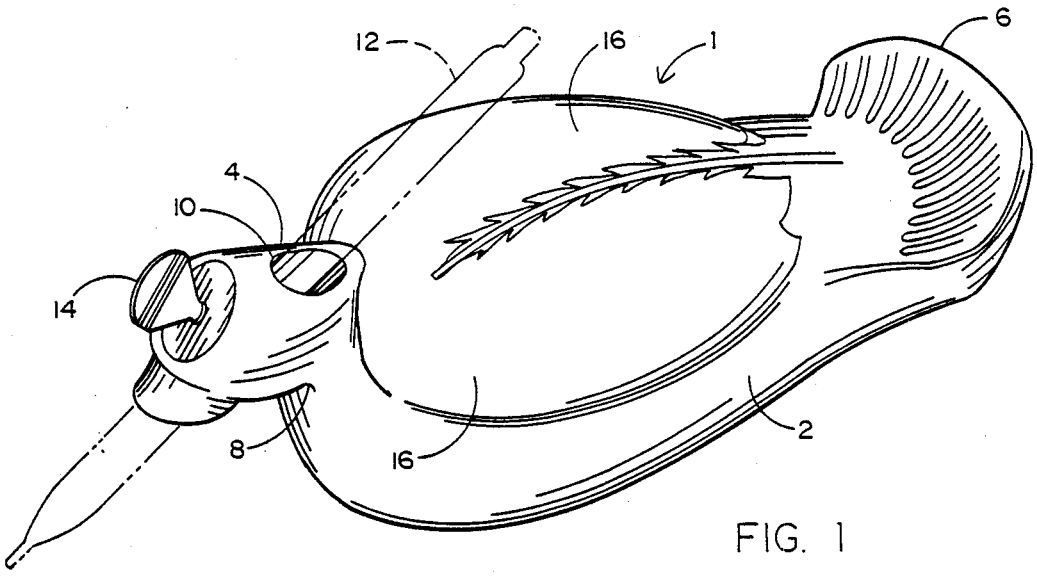
FIG. 1 is a perspective view of a combination hand support and writing instrument holder which forms the present invention and which releasably retains an associated writing instrument.

The combined hand support and writing instrument holder which forms the present invention is best described while referring to the drawings, where FIG. 1 shows a hand support 1 having the ornamental design of a bird or a duck. However, it is to be understood that the particular ornamental appearance illustrated in FIG. 1 is for aesthetic purposes only and is not to be regarded as a limitation of the present invention. Therefore, other suitable appearances and shapes may be employed for hand support 1, including that shown in copending Design Patent Application No. 68,322 filed July 1, 1987. The hand support and writing instrument holder 1 shown in FIG. 1 is preferably fabricated from a lightweight, easily molded material, such as plastic, polyester resin, or the like.

Hand support 1 includes a body portion 2, a head portion 4, and a tail portion 6. The head portion 4 of hand support 1 is coextensively connected to and extended outwardly and upwardly from one end of the body portion 2 by way of a relatively narrow neck 8. A hole 10 extends continuously through the head portion 4. The hole 10 is sized so as to removably receive therethrough a conventional writing instrument (shown in phantom and designated by the reference numeral 12). A clamping device 14 is transversely aligned with the writing instrument 12 and movable through a corresponding hole formed in head portion 4. Accordingly, the clamping device 14 can be moved into contact with and tightened (or loosened) against the writing instrument 12 to releasably secure the instrument within hole 10 and thereby prevent the inadvertent displacement thereof.

Coextensively connected to and extending outwardly and upwardly from the opposite end of body portion 2 is the tail portion 6. In a preferred embodiment of the invention, the tail portion 6 is curved to form an upwardly turned rim at the rear of the body portion 2. As as will be disclosed in greater detail hereinafter when referring to FIGS. 5 and 6, tail portion 6 is suitably shaped so that some of the user's hand may be received therein, whereby both lateral and rotational movement of the hand support 1 relative to a writing surface may be more easily and accurately controlled.

Nevertheless, it is also within the scope of this invention to form the tail portion of hand support 1 as a rearward extension of the body portion 2 rather than as a curved rim, as shown in FIG. 1. To this end, and referring to FIG. 2 of the drawings, a relatively flat tail portion 6-1 is shown coextensively connected to and extended outwardly from the rear of body portion 2. The flat tail portion 6-1 of FIG. 2 may be preferred by those with relatively large hands or by those who desire a continuous and generally flat surface upon which to rest their hand while writing.

Figure 3:
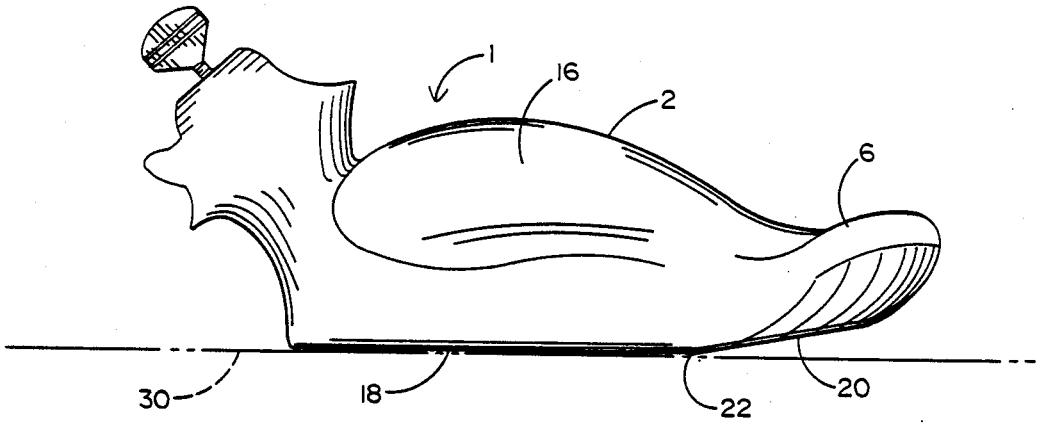
FIG. 3 is a side view of the hand support and writing instrument holder of FIG. 1.

The body portion 2 of hand support 1 is now described in detail while referring concurrently to FIGS. 1 and 3. The body portion 2 is provided with a suitable length and width which corresponds to the dimensions of the average hand. The top of the body portion 2 is contoured to conform to the shape of the hand so that the manual control of hand support and writing instrument holder 1 can be maximized. That is to say, the body portion 2 is provided with a pair of oppositely disposed, laterally extending sides or wings 16 at which to accommodate the palm of the user. In this regard, it may be appreciated that the top contour of body portion 2 is symetrical about the longitudinal axis of the hand support 1 so that said support is readily and conveniently accessible to both right and left handed individuals alike.

In accordance with an important feature of the present invention, the bottom of body portion 2 is provided with first and second planar surfaces 18 and 20. The first planar surface 18 runs horizontally along hand support 1 and is aligned parallel to the writing surface (shown in phantom and represented by the reference numeral 30). Thus, and as will soon be explained, the hand support 1 is adapted to slide over the writing surface 30 at the planar surface 18 thereof. The second planar surface 20 projects outwardly and upwardly from the first planar surface 18 at an integral pivot point 22 therebetween. The second planar surface 20 is located generally below the tail portion 6 of hand support 1. More particularly, the planar surface 20 forms an acute angle (of approximately 15 degrees) with the writing surface 30. Accordingly, the hand support 1 is also adapted to rock back and forth around pivot point 22 for an important advantage that will soon be described.

Figure 2:
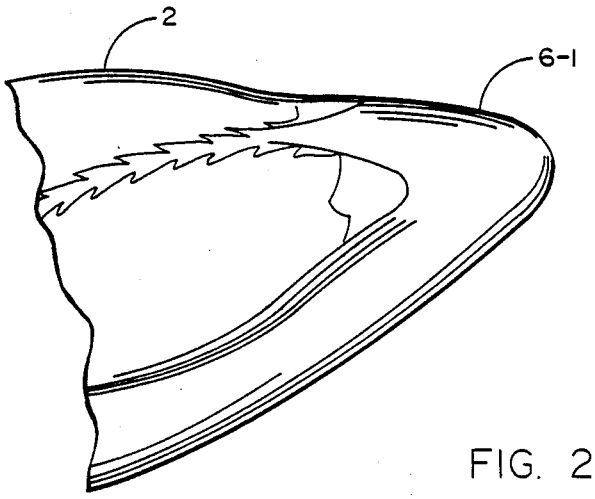
FIG. 2 shows a detail of the tail portion of a hand support and writing instrument holder which forms an alternate embodiment of the present invention.
Figure 4:
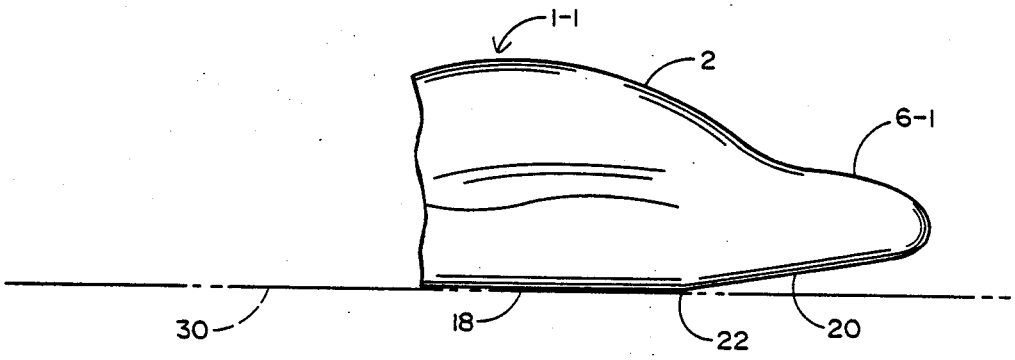
FIG. 4 is a partial side view of the hand support and writing instrument holder which includes the alternate embodiment of FIG. 2.

FIG. 4 shows the alignment of the first and second planar surfaces 18 and 20 of body portion 2 and the location of the pivot point 22 for a hand support 1-1 having the laterally extending tail portion 6-1 of FIG. 2. Like the hand support 1 of FIG. 3, the planer surface 20 of FIG. 4 is angled relative to writing surface 30 so that the hand support 1-1 is adapted to rock back and forth around pivot point 22.

Figure 5:
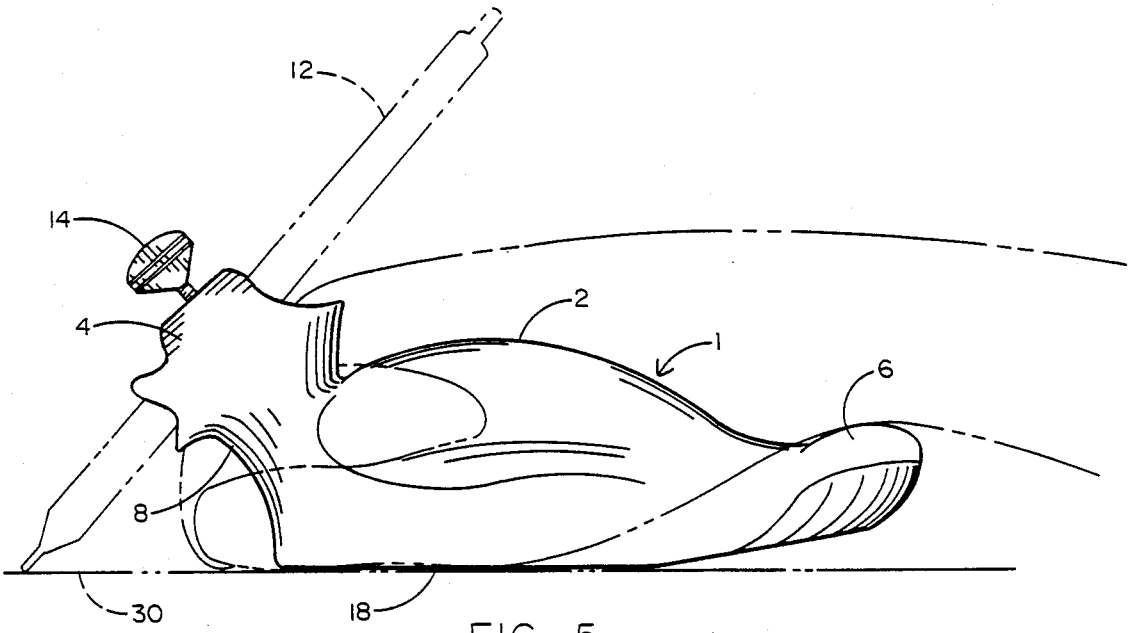
FIG. 5 illustrates the hand of the user engaging the hand support and writing instrument holder of FIG. 1 for writing words, and the like, on a writing paper.
Figure 6:
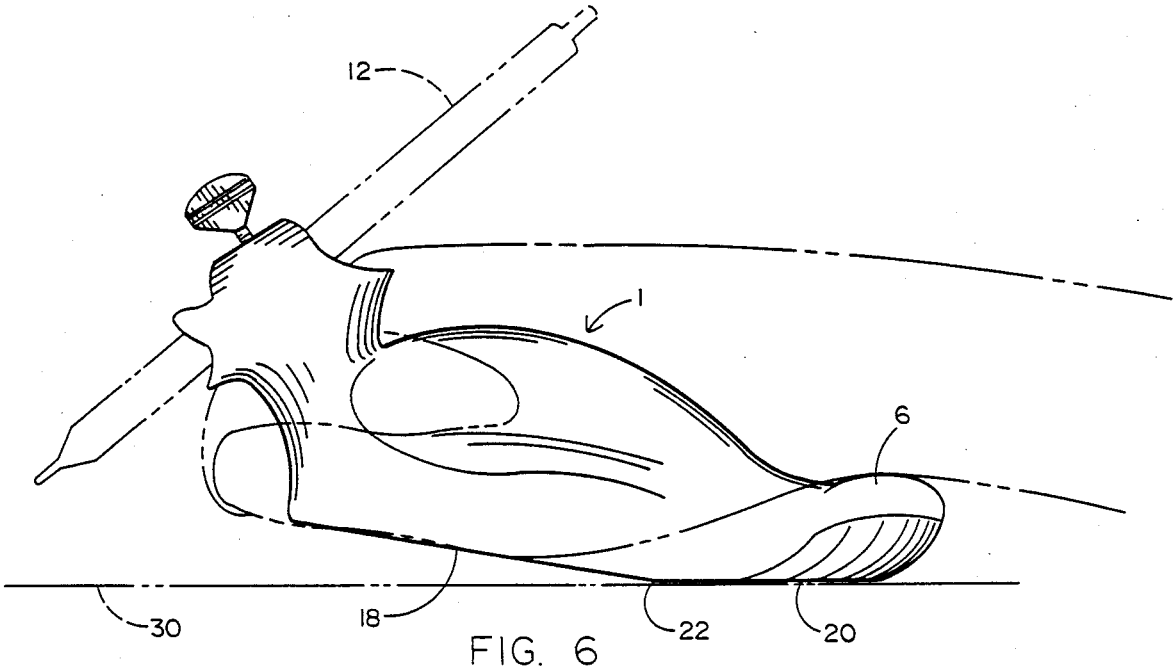
FIG. 6 illustrates the hand of the user engaging the hand support and writing instrument holder of FIG. 1 for rotating the combination about a pivot point and thereby raising the writing instrument above the writing surface so that said instrument can be relocated without making extraneous marks on the writing paper and without requiring the user to first remove his hand.

The operation of hand support 1 is now described while referring to FIGS. 5 and 6 of the drawings. In FIG. 5, a writing instrument 12 is inserted into and secured within the hole formed through head portion 4. That is, the position of writing instrument 12 is fixedly established by clamping device 14 so that the writing point thereof will be held in contact with the writing surface 30 upon which is laid a piece of writing paper. The user then rests his hand (shown in phantom) on support 1 such that his palm embraces body portion 2, his fingers extend into communication with the neck area 8, and his wrist is received by the curved rim formed by tail portion 6. By communicating with the body portion 2, tail portion 6 and neck 8, the user is better able to move the hand support 1 with a higher degree of precision. The user then proceeds to slide hand support 1 at the planar surface 18 thereof across the writing paper to trace out a word, draw a line, etc. and thereby cause writing instrument 12 to write the corresponding words or line with a steady, continuous motion that may be reliably and accurately controlled. Hence, the user is provided with the ability to write legibly by grasping and sliding the hand support and writing instrument holder 1 along the planar surface 18 thereof.

At the end of a word or line, and referring to FIG. 6, the user applies a rotational pressure to hand support 1 by pressing downwardly upon the tail portion 6. Accordingly, the support 1 rotates in a clockwise direction around pivot point 22 such that both planar surface 18 thereof and the writing instrument 12 are raised above the writing surface 30. The user is then free to slide hand support 1 at the second planar surface 20 to any other location on the writing paper or in the alternative, to remove the hand support from the paper altogether. However, by virtue of the rocking or rotational movement of hand support 1 around pivot point 22, the writing instrument 12 may be easily relocated relative to writing surface 30 so as to avoid an unintentional marking of the writing paper by writing instrument 12 and minimize the strain to the hand and wrist of the user. Moreover, the user is not required to remove his hand from the hand support 1 during the sliding of hand support 1 on planar surface 20 and the corresponding relocation of writing instrument 12. When a new mark is to be made upon the paper, the user merely rotates the hand support 1 in a counter-clockwise direction around pivot point 22 so as to return the writing instrument 12 back into contact with the paper.

It will be apparent that while a preferred embodiment of the invention has been shown and described, various modifications and changes may be made without departing from the true spirit and scope of the invention.

Having thus set forth a preferred embodiment of the invention, what is claimed is:

1. A writing aid comprising a combination hand support and writing instrument holder and including:

a movable body portion having a surface to receive and support the palm of a user, said body portion having a pair of laterally extending side panels projecting outwardly and in opposite directions therefrom, some of the user's fingers engaging one of said side panels so that the movement of said body portion may be accurately controlled;

a head portion projecting outwardly from one end of said body portion and having means for retaining a writing instrument, such that a movement of said body portion along the plane of a writing paper causes a corresponding movement of the writing instrument over the paper;

a neck portion by which to connect said head portion to said body portion, said neck portion being narrower than said head portion to receive other fingers of the user thereagainst to further control the movement of said body portion;

a tail portion projecting outwardly from an end of said body portion opposite the end to which said head portion is connected, said tail portion receiving a downward pressure that is applied thereto by the user; and pivot means around which said body portion is adapted to rotate when a downward pressure is applied to said tail portion so that the writing instrument is either moved into contact with the writing paper when said body portion is rotated around said pivot means in a first direction or the writing instrument is moved out of contact with the writing paper when said body portion is rotated around said pivot means in a direction opposite to said first direction.

2. The writing aid recited in claim 1, wherein said tail portion is curved upwardly to form a rim, such that a downwardly directed pressure applied from the user's wrist to said upwardly curved rim will facilitate the rotation of said body portion around said pivot means for causing the writing instrument to be moved out of contact with the writing paper.

3. The writing aid recited in claim 1, wherein the bottom of said body portion includes said pivot means and first and second planar surfaces which are interconnected with one another at said pivot means, said second planar surface being angled relative to said first planar surface so that said body portion may rotate back and forth around said pivot means and between said first and second planar surfaces for successively raising and lowering said writing instrument out of and into contact with the writing paper.

4. The writing aid recited in claim 1, wherein said head portion has means for releasably retaining the writing instrument, said retaining means including a hole formed through said head portion for receiving said writing instrument therethrough and clamping means communicating with said writing instrument within said hole for preventing a displacement of said writing instrument relative to said hole.

* * * * *